United States Patent [19]

Arias et al.

[11] 4,261,447

[45] Apr. 14, 1981

[54] SUITCASE CART

[76] Inventors: Antonio M. Arias, 150 E. 49th St., New York, N.Y. 10017; Juan F. Cerna, 8889 Fountainbleu Blvd., Miami, Fla. 33172

[21] Appl. No.: 115,797

[22] Filed: Jan. 28, 1980

[51] Int. Cl.[3] ..... A45C 5/14

[52] U.S. Cl. ..... 190/18 A; 280/47.26; 280/47.29

[58] Field of Search ..... 190/18 A; 280/35, 37, 280/43.1, 43.24, 47.17, 47.18, 47.28, 47.29, 47.26

[56] References Cited

U.S. PATENT DOCUMENTS

| | | | |
|---|---|---|---|
| 2,733,076 | 1/1956 | Burnett | 280/47.29 X |
| 3,960,252 | 6/1976 | Cassimally | 190/18 A |
| 4,026,570 | 5/1977 | Feinberg | 190/18 A X |
| 4,036,336 | 7/1977 | Burtley | 190/18 A |
| 4,114,916 | 9/1978 | Oyama | 280/47.29 |

*Primary Examiner*—Donald F. Norton

*Attorney, Agent, or Firm*—Oltman and Flynn

[57] ABSTRACT

The suitcase cart includes a suitcase and parallel tubular frame members affixed to the bottom of the suitcase. The frame members are L-shaped. A U-shaped handle telescopes relative to one pair of legs of the frame members, and a U-shaped base member telescopes relative to the other pair of legs of the frame members. Wheels are provided at the corners of the frame members. The handle is manipulated to wheel the suitcase along with or without an additional article on the base.

8 Claims, 13 Drawing Figures

SUITCASE CART

BACKGROUND OF THE INVENTION

U.S. Pat. No. 4,036,336-Burtley describes a wheeled suitcase convertible to a luggage cart in which a handle is combined with pivotal support arms attached to the bottom of the suitcase providing an additional luggage supporting surface. The general purpose of the present invention is to provide a suitcase cart with an extensible handle and also an extensible base that provides a more reliable additional luggage supporting surface.

SUMMARY OF THE INVENTION

In accordance with the present invention, a pair of substantially L-shaped tubular frame members are provided, each having two legs joining each other at a corner. One leg of each of the frame members is affixed to the bottom wall of the suitcase and extends parallel to two respective side walls of the suitcase. The other leg of each of the frame members extends parallel to the same side walls and is adjacent to a third side wall. A generally U-shaped handle has parallel legs telescopically received in the first legs of the frame members for manipulating the suitcase. The handle has a cross arm movable from a retracted position near the fourth side wall to an extended operating position spaced outward from the fourth side wall. A generally U-shaped base has parallel legs telescopically received in the other legs of the frame members for retaining an additional article. The base has a cross arm movable from a retracted position near the top wall to an extended operating position spaced separate from the top wall. Wheels are affixed to the corners of the L-shaped frame members for permitting the suitcase to be wheeled along by manipulation of the handle with or without an additional article on the base.

Accordingly, it is an object of the present invention to provide a wheeled suitcase with an improved handle and base structure for wheeling the suitcase along by manipulation of the handle with or without an additional article on the base.

Another object of the invention is to provide a base for a wheeled suitcase with a handle, the base having a cross arm which provides continuous support across the width of the article which is received on it.

Other objects of this invention will appear from the following description and appended claims, reference being had to the accompanying drawings forming a part of this specification wherein like reference characters designate corresponding parts in the several views.

Figure 1:
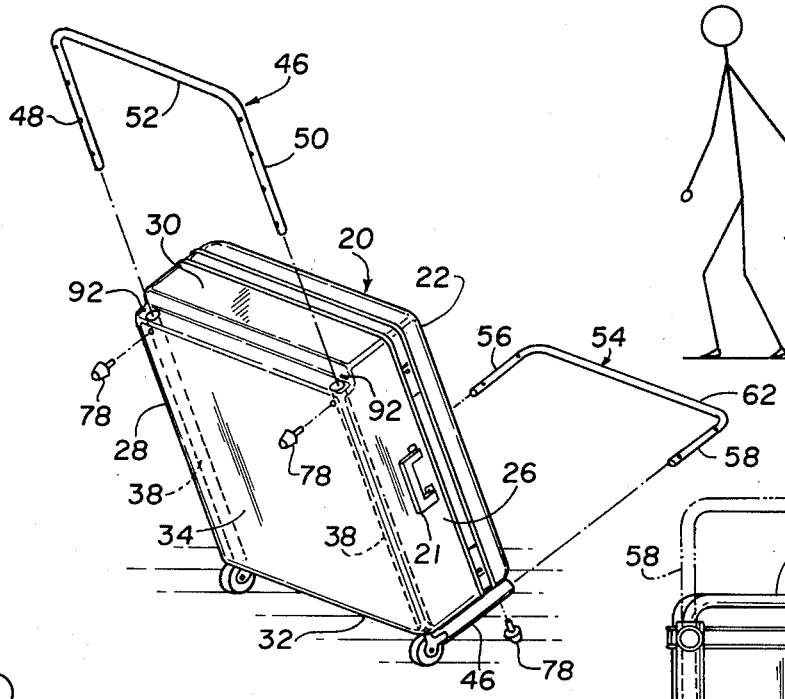
FIG. 1 is a perspective view of a wheeled suitcase cart in accordance with one embodiment of the invention.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

The suitcase 20 includes a top wall 22, a partial bottom wall 24, a front wall 26, a rear wall 28, a left side wall 30 and a right side wall 32. The suitcase 20 also includes a cover 34 extending parallel to the bottom wall 24 for covering the handle as will be explained. The suitcase has a carrying handle 21.

Figure 11:
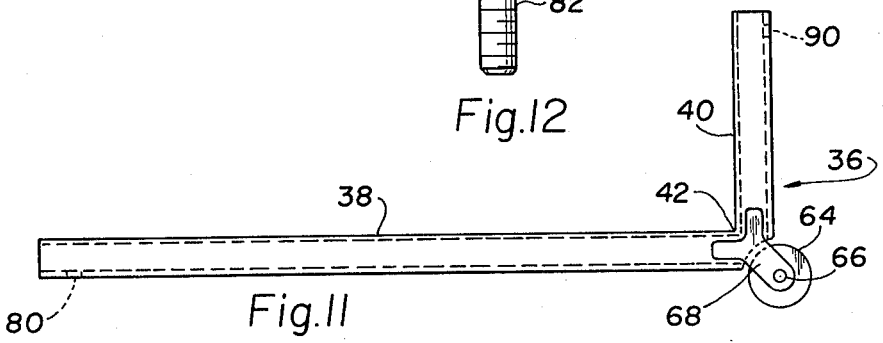
FIG. 11 is an elevational view of a generally L-shaped frame member included in the suitcase cart.

The suitcase cart also includes a pair of substantially L-shaped, tubular frame members 36 (FIG. 11) for supporting the suitcase. Each of the tubular frame members 36 has two legs 38 and 40 which are perpendicular to each other and join each other at a corner 42. The legs 38 of the frame members 36 are telescopically received in openings 44 (FIG. 7) adjoining the bottom wall 24 of the suitcase so that the legs 38 are affixed to the bottom wall 24 of the suitcase and extend parallel to the side walls 26 and 28.

The other legs 40 of the frame members 36 also extend parallel to the side walls 26 and 28 adjacent the right side wall 32. Legs 38 are parallel to each other and legs 40 are also parallel to each other. The two legs of each pair are spaced from each other.

Figure 2:
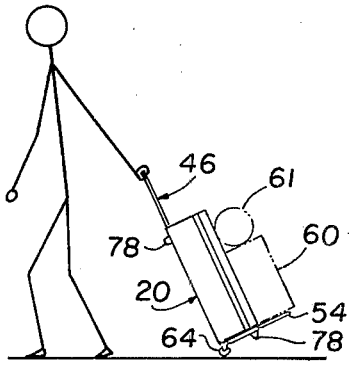
FIG. 2 is a schematic view showing the wheeled suitcase cart being pulled along on wheels by a user.
Figure 5:
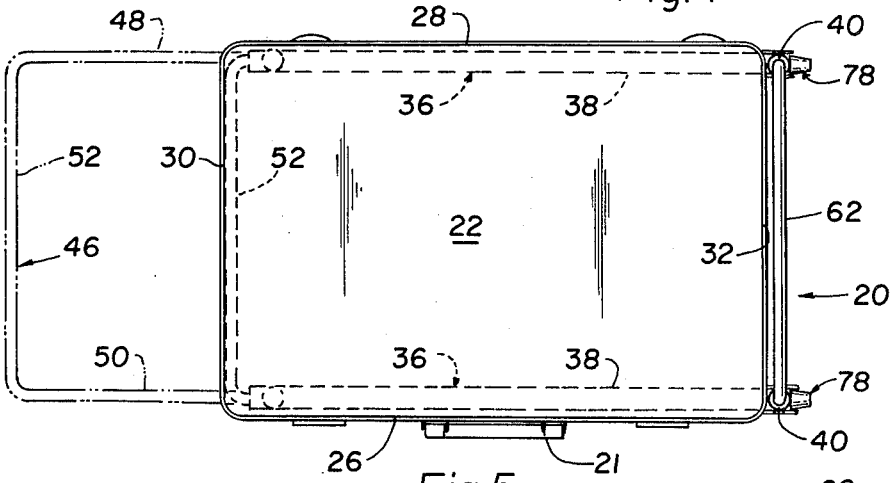
FIG. 5 is a top plan view showing a handle in a retracted condition and also in an extended condition.

A generally U-shaped handle 46 has parallel legs 48 and 50 telescopically received in the legs 38 for manipulating the suitcase as shown in FIG. 2. The handle 46 has a cross arm 52 providing a grip that is movable from a retracted position near the left side wall 30 to an extended operating position spaced outwardly from the left side wall 30 as shown in dashed lines for example in FIGS. 5 and 6.

A generally U-shaped base 54 has parallel legs 56 and 58 that are received in the legs 40 of the frame members 36 for retaining an additional article 60 as shown in FIG. 2. The additional article 60 simply rests on the base 54 when it is extended, and the article 60 also rests on the suitcase 20 as shown in FIG. 2. Still another article 61 is shown resting on top of the article 60.

Figure 6:
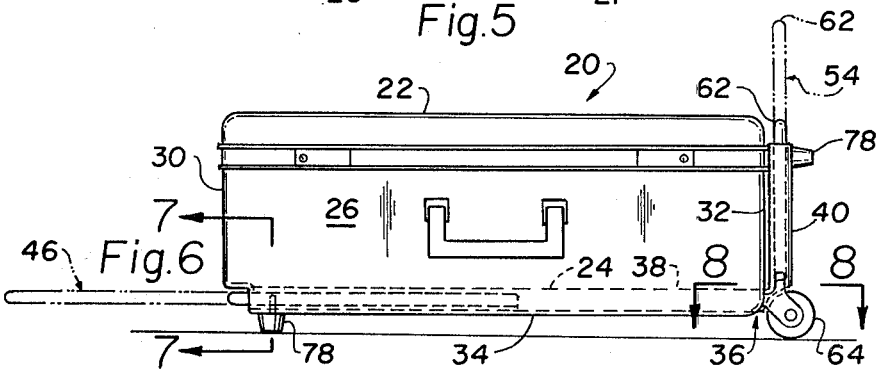
FIG. 6 is a front elevational view of the wheeled suitcase cart.

The base 54 has a cross arm 62 that is movable from a retracted position near the top wall 22 to an extended operating position spaced upward from the top wall 22 as shown for example in FIG. 6. When the base 54 is in the extended position, the cross arm 62 supports the article 60 across its entire width, and thus provides a very stable platform for articles of a large range of sizes. Such continuous support across the width of the suitcase cart is an important feature of the invention.

A pair of wheels 64 are affixed to the corners 42 of the L-shaped frame members 36 for permitting the suitcase to be wheeled along as shown in FIG. 2 by manipulation of the handle 46 with or without an additional article on the base 54. The wheels 64 are mounted on shafts 66 extending between brackets 68. A pair of the brackets 68 are welded or otherwise affixed to the corner 42 of each of the frame members 36.

Figure 7:
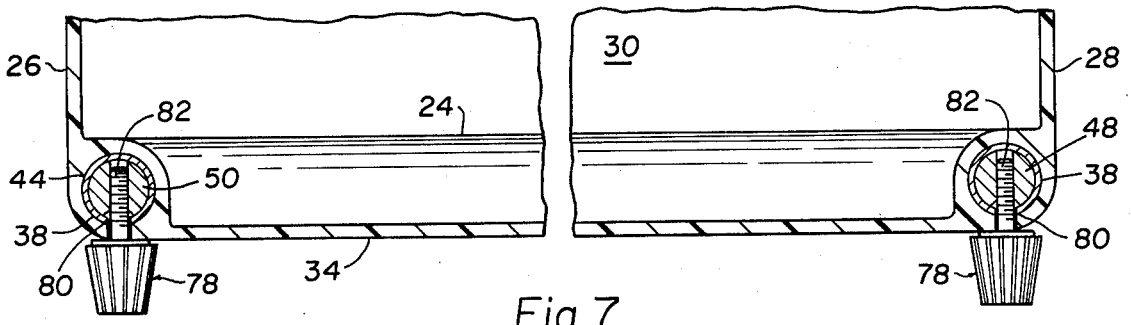
FIG. 7 is a fragmentary sectional view taken along line 7—7 of FIG. 6.
Figure 8:
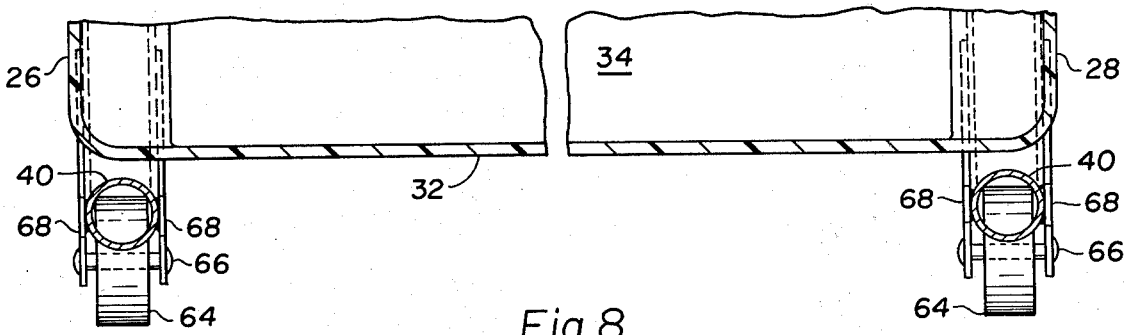
FIG. 8 is a fragmentary sectional view taken along 8—8 of FIG. 6.
Figure 9:
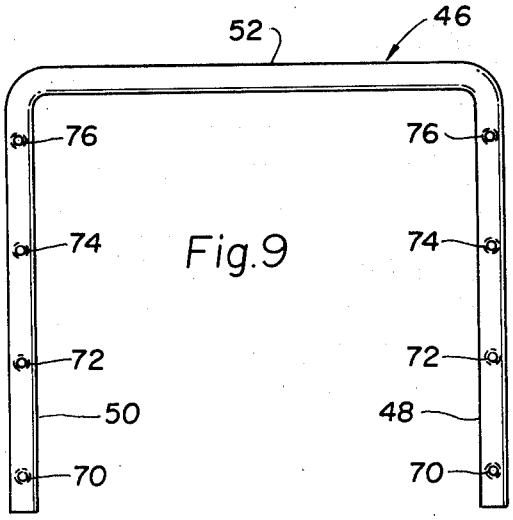
FIG. 9 is a plan view of a generally U-shaped handle included in the suitcase cart.
Figure 10:
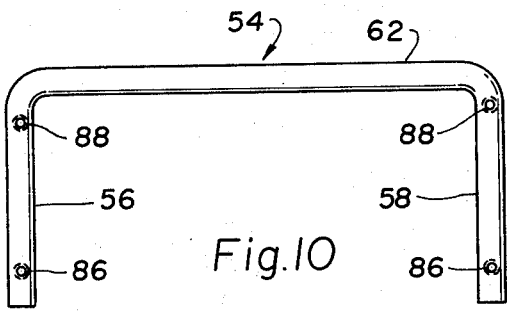
FIG. 10 is a plan view of a generally U-shaped base included in the wheeled suitcase cart.
Figure 12:
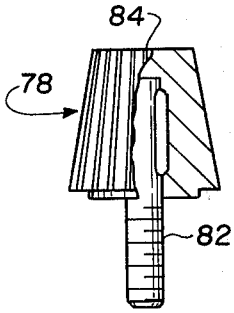
FIG. 12 is a plan view of a glide device, partly broken away, included in the suitcase cart.

The leg 50 of handle 46 has four holes 70, 72, 74, and 76. The other leg 48 of handle 46 also has four holes 70, 72, 74 and 76. A glide device 78 is provided for each of the legs 48 and 50. The legs 38 of the frame members 36 have clearance holes 80 through which a screw 82 of the two glide members 78 extend freely. The holes 70, 72, 74 and 76 have threads, and the screws 82 also have threads that screw into the threads of the holes as shown in FIG. 7. The glide surface 84 is positioned so that the suitcase 20 is supported in a level position when resting on the glide surface 84 as shown in FIG. 6.

Two additional glides 78 are provided for the two legs 56 and 58 of the base 54. The legs 56 of base 54 has two holes 86 and 88. The leg 58 of base 54 also has two holes 86 and 88. All these holes 86 and 88 have threads. The legs 40 have clearance holes 90 through which the screws 82 of the glide members 78 extend freely. The screw portion 82 of each glide member screws into either the openings 86 or the openings 88 depending upon the position of the base 54.

The holes 76 are engaged when the handle 46 is in the retracted stowage position. The holes 70 are engaged when the handle is in a fully extended postion. The holes 72 or 74 are engaged when the handle is in either of two intermediate extended positions. The holes 86 are engaged when the base 54 is fully extended. The holes 88 are engaged when the base 54 is in the fully retracted position.

Figure 13:
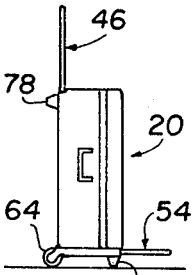
FIG. 13 shows the suitcase cart resting on its base.

The glide surface 84 is adjusted so that when the suitcase is in the upright position shown in FIG. 13, it is level. The bottom cover 34 of the suitcase is recessed slightly at 92 from the left side wall 30 to receive the cross arm 52 of the handle 46 in the retracted position with the cross arm 52 slightly inward from the left side wall 30. This is an optional feature.

Figure 4:
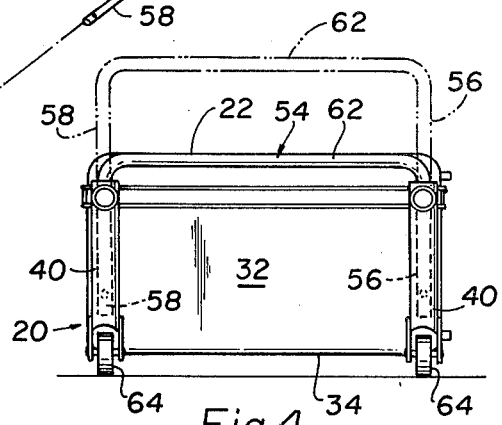
FIG. 4 is an elevational view of the suitcase cart showing a base in a retracted condition and also in an extended condition.
Figure 3:
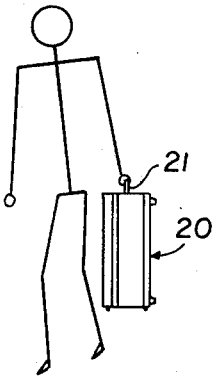
FIG. 3 is a schematic view showing the wheeled suitcase cart being carried by a user.

As shown in FIG. 4, the legs 40 terminate just under the top wall 22 of the suitcase so that when the cross arm 62 is fully retracted, it is located in a recessed position just slightly below the top wall 22.

The suitcase is generally rectangular in plan and the longer sides of the rectangle are parallel to the frame members.

The suitcase cart can be raised or lowered to a different level simply by grasping and manipulating the two crossarms 52 and 62, and this can be done even with additional luggage in place.

Note that it is possible to remove the frame members from the holes 44 after first removing the handle 46. Then the handle 46 can be reattached to the frame members and the frame, handle and base can be used as a separate cart. The handle 46 and base 54 can be made to telescope widthwise to make the cart narrower.

I claim:

1. In combination with a suitcase having a top wall, a bottom wall and four side walls, the improvement comprising:

a pair of substantially L-shaped, tubular frame means for supporting said suitcase and each having two legs joining each other at a corner;

one leg of each of said frame means being affixed to the bottom wall of said suitcase and extending parallel to two respective side walls with said one legs being parallel to each other in spaced relation;

the other leg of each of said frame means extending parallel to said respective side walls adjacent a third of said side walls with said other legs parallel to each other in spaced relation;

a generally U-shaped handle means having parallel legs telescopically received in said one legs of said frame means for manipulating said suitcase;

said handle means having a cross arm movable from a retracted position near the fourth side wall to an extended operating position spaced outward from said fourth side wall;

a generally U-shaped base means having parallel legs telescopically received in said other legs of said frame means for retaining an additional article;

said base means having a cross arm movable from a retracted position near the top wall to an extended operating position spaced upward from said top wall;

and wheel means affixed to the corners of said L-shaped frame means for permitting said suitcase to be wheeled along by manipulation of said handle means with or without an additional article on said base means.

2. The suitcase according to claim 1 in which:

said suitcase has a cover over said one leg of said frame means for hiding the same.

3. The suitcase according to claim 2 in which:

said cover is recessed from said fourth side wall to receive said cross arm of said handle means in said retracted position.

4. The suitcase according to claim 1 in which:

said legs and said handle means and said base means each have openings therein corresponding to said extended and retracted positions;

and said suitcase further includes glide means removably received in certain ones of said openings for supporting said suitcase in alternate level positions, and for retaining said cross arms in said extended and retracted positions.

5. The suitcase according to claim 4 in which:

said openings in said handle means and said base means have threads and said glide means includes screw means screwed into said threads respectively.

6. The suitcase according to claim 5 in which:

said other legs of said frame means terminate under said top wall to permit recessing of said cross arm of said base means relative to said top wall.

7. The suitcase according to claim 6 which:

said suitcase has a cover over said one legs of said frame means for hiding the same.

8. The suitcase according to claim 7 in which:

said cover is recessed from said fourth side wall to receive said cross arm of said handle means in said retracted position.

* * * * *